US007170824B2

(12) United States Patent
Wilmouth

(10) Patent No.: US 7,170,824 B2
(45) Date of Patent: Jan. 30, 2007

(54) CALENDAR MECHANISM HAVING MEANS DRIVING AND CORRECTING TWO INDICATORS

(75) Inventor: Jean Wilmouth, deceased, late of Le Sentier (CH); by Nell Wilmouth, legal representative, Le Sentier (CH); by Hubert Wilmouth, legal representative, Creutzwald (FR); by Liliane Wilmouth, legal representative, Creutzwald (FR)

(73) Assignee: Montres Breguet SA, L'Abbaye (CH)

( * ) Notice: Subject to any disclaimer, the term of this patent is extended or adjusted under 35 U.S.C. 154(b) by 299 days.

(21) Appl. No.: 10/992,236

(22) Filed: Nov. 19, 2004

(65) Prior Publication Data

US 2005/0281136 A1 Dec. 22, 2005

(30) Foreign Application Priority Data

Nov. 25, 2003 (EP) ..... 03027077

(51) Int. Cl.
*G04B 27/00* (2006.01)

(52) U.S. Cl. ..... 368/18; 368/35

(58) Field of Classification Search ..... 368/18, 368/20–40

See application file for complete search history.

(56) References Cited

U.S. PATENT DOCUMENTS

| | | | | |
|---|---|---|---|---|
| 203,640 | A * | 5/1878 | Paddock | 368/31 |
| 2,720,746 | A | 10/1955 | Punzmann | |
| 3,350,873 | A | 11/1967 | Egger et al. | |
| 2003/0189875 | A1 | 10/2003 | Wilmouth | |

FOREIGN PATENT DOCUMENTS

| | | |
|---|---|---|
| CH | 341115 | 9/1959 |
| CH | 584 926 | 2/1977 |
| CH | 624 533 | 8/1981 |
| EP | 129 683 | 1/1985 |
| FR | 1 517 236 | 3/1968 |
| GB | 2095438 | 9/1982 |

* cited by examiner

*Primary Examiner*—Vit Miska
*Assistant Examiner*—Sean Kayes
(74) *Attorney, Agent, or Firm*—Sughrue Mion, PLLC

(57) ABSTRACT

The calendar mechanism for a watch includes two rotating indicators provided with respective toothed wheels (11, 14), indicating for example the date and the phase of the moon or the day of the week, and drive lever (21) provided with two beaks (22, 23) for making the corresponding indicator move forward one step, depending upon whether it is pivoting in one direction or the other. The daily movement forward of the indicators is assured by a drive wheel (20) making one revolution per day and provided with a pin (38) which cooperates with a cam surface (33) of the drive lever. In order to correct the indicators independently of each other, a gear train (44) actuated by a control stem of the watch causes a correction wheel (50) to rotate, which acts on a nose of the drive lever (21) to pivot the latter selectively in one direction or the other. The correction wheel (50) mounted on a lever (46), controlled by a cam (39) of the drive wheel (20), is released from the correction wheel (44) as long as the drive wheel actuates the drive lever.

8 Claims, 5 Drawing Sheets

CALENDAR MECHANISM HAVING MEANS DRIVING AND CORRECTING TWO INDICATORS

This application claims priority from European Patent Application No. 03027077.1 filed Nov. 25, 2003, the entire disclosure of which is incorporated herein by reference.

BACKGROUND OF THE INVENTION

The present invention concerns a calendar mechanism in a watch, including a first and a second indicator which are each associated with a rotating wheel set provided with a toothing, a drive lever provided with two beaks arranged for acting respectively on the toothing associated with the first or second indicator, depending upon the pivoting direction of the drive lever, to make the corresponding indicator move forward one step, a drive wheel making one revolution per day and provided with a drive element which cooperates with a cam surface of the drive lever to make said lever pivot each day in one direction and the other from a neutral position and thus make said beaks act on said toothings, and manual correction means for making the first and second indicators move forward step by step independently of each other, A mechanism of this kind, disclosed in U.S. Pat. No. 2,720,746, daily activates a date indicator and a day indicator in a miniature clock, owing to a lever with two arms whose ends each carry a click cooperating with a peripheral toothing of the indicator disc concerned. This lever includes a hole whose sinuous contour forms a cam surface and in which a cam follower runs carried by a wheel that makes one revolution per day. This results in a very simple drive mechanism for the indicators. However, correction of the calendar indicators requires two correction devices, independent of the daily driving and each associated with the respective indicator, which increases the total space requirement of the mechanism and requires two manual correction members.

FR Patent No. 1 517 236 discloses a calendar mechanism with date and day indicators that can be used in a watch and which also includes a common drive element for both indicators, this element having a hole of complex shape in which a drive finger rotates. In this embodiment, the drive element makes a combination of sliding and pivoting movements. A device for correcting the date by means of the time setting stem is also provided, which is completely independent of the drive element.

There is also known, from CH Patent No. 584 926, a common correction mechanism for the date and day indicators from the winding stem of a watch, while the daily driving of said indicators is performed by other members. Here too, the common element that acts sometimes on the first indicator and sometimes on the second makes a combination of sliding and pivoting movements.

SUMMARY OF THE INVENTION

It is an object of the present invention to simplify the construction and control of the calendar mechanism, taking account of the members necessary for correcting indications. A basic idea of the invention consists in using certain common members for the daily driving of the two indicators and for the individual manual correction of each indicator.

In particular, according to the present invention, in a mechanism of the type indicted in the preamble hereinbefore, the manual correction means act on the drive lever so as to pivot it selectively in one direction or another in order to cause the corresponding indicator to move forward one step. Preferably, the manual correction means include a correction wheel driven in rotation selectively in one direction or the other by a manual control stem via a correction gear train, the correction wheel having one or more projecting elements arranged to press against a nose of the drive lever so as to pivot the latter in one direction or the other depending upon the rotational direction of the correction wheel.

Thus the bulkiest element of the kinematic chain driving the two indicators, namely the drive lever, is advantageously reused for correcting the indicators. Moreover, it activation in both directions from the same manual control member for correcting selectively one indicator or the other, constitutes a saving of means? Since this member is the control stem, which is already present in the watch, the number and size of the correction mechanism elements are all the more restricted and manipulation is easier.

Other characteristics and advantages of the present invention will appear from the following description of one presently preferred embodiment given by way of non limiting example in connection with the annexed drawings.

DETAILED DESCRIPTION OF ONE EMBODIMENT

Figure 1:
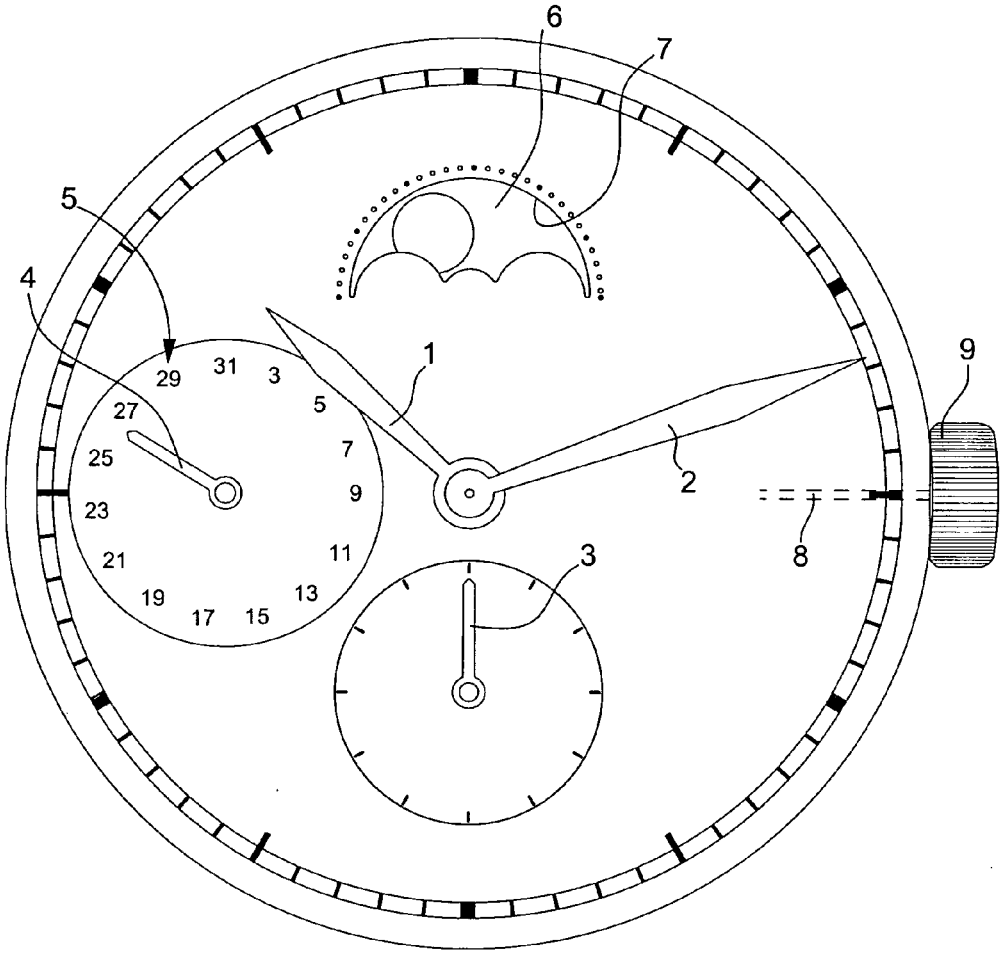
FIG. 1 shows schematically the front face of a watch fitted with a calendar mechanism according to the invention, including, in this example, a date indicator and a moon phase indicator.

The wristwatch, whose dial 10 can be seen in FIG. 1, includes an analogue time display, with an hour hand 1, a minute hand 2 and a second hand 3, which are driven by a watch movement of any type. The watch further includes a calendar display including, in the present case, a date indicator, formed by a hand 4 which rotates before a scale 5 with thirty-one positions, and a moon phase indicator, formed in a conventional manner by a disc 6 rotating behind an aperture 7 of a particular shape. FIG. 1 also shows schematically the manual control member 8 of the watch, provided with a crown 9 outside the case.

Figure 2:
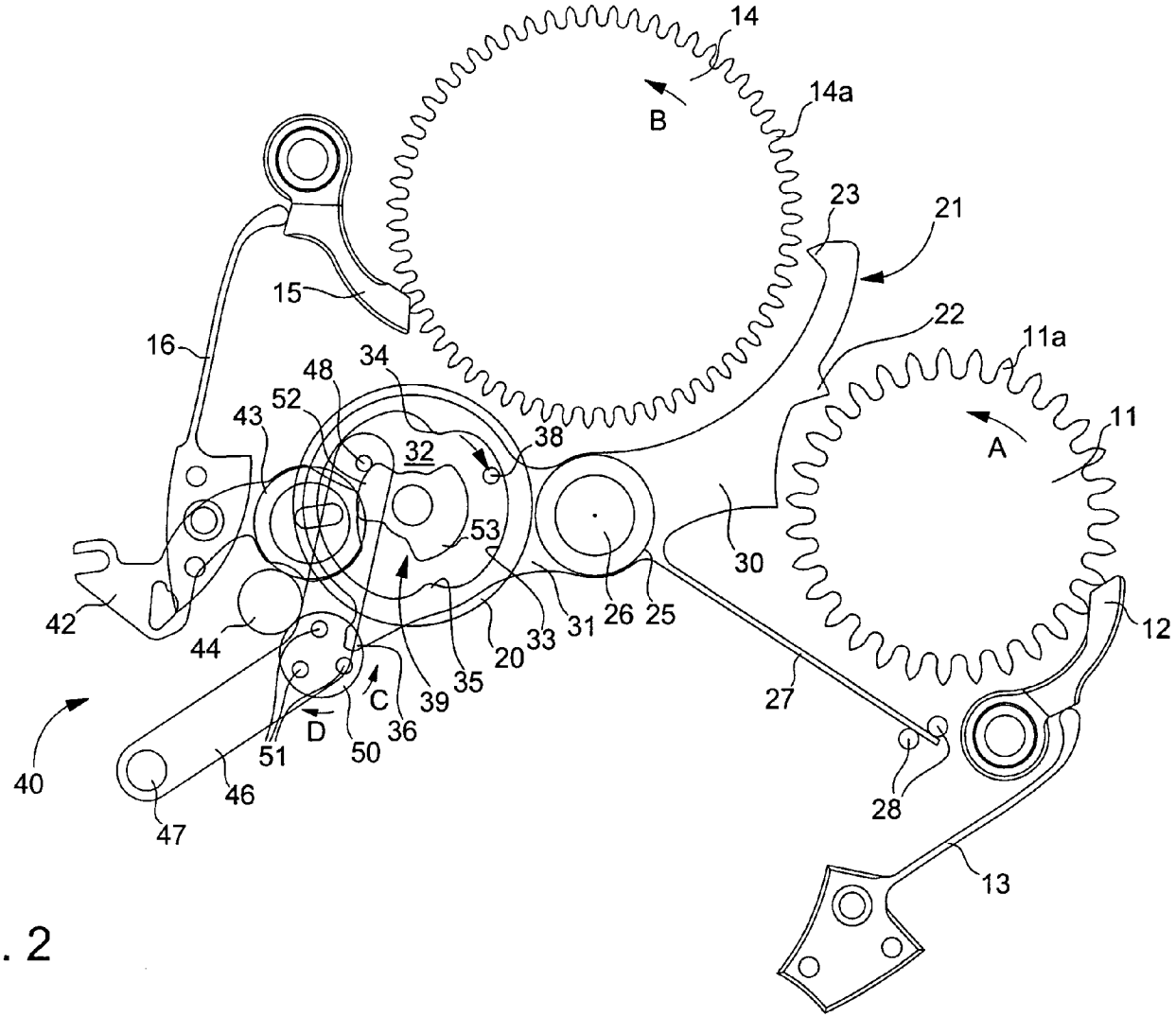
FIG. 2 is a transparent view of the calendar mechanism, in a balanced position, after the daily movement forward of the date indicator.

In FIG. 2 the calendar mechanism elements are seen from the opposite side of the dial and they are shown in transparency in order to facilitate comprehension. A date star-wheel 11 having a toothing 11*a* of thirty-one teeth forms a rotating wheel set with hand 4 shown in FIG. 1. Its successive positions are maintained by means of a jumper-spring 12 shouldered by a spring 13. A moon star-wheel 14 having a toothing 14*a* of fifty-nine teeth forms a rotating wheel set with the moon disc 6. It successive positions are maintained by means of a jumper-spring 15 shouldered by a spring 16.

Each of star-wheels 11 and 14 rotate by one step each day in the direction of arrows A and B, owing to a drive wheel 20 which makes one revolution per day and acts on a drive lever 21 having a beak 22 arranged to move date star-wheel 11 forward and a beak 23 arranged to move moon star-wheel 14 forward, such that each star-wheel moves forward enough for its tooth that is lifting the corresponding jumper-spring, to pass over the other flank of the jumper-spring. In a known manner, drive wheel 20 is driven by meshing on hour wheel 25 of the watch movement, which is secured to hour hand 1 and makes one revolution in twelve hours. Lever 21 is pivotably mounted about shaft of hour wheel 25, i.e. the central axis 26 of the watch movement, which considerably simplifies the positioning of the elements of the mechanism described here. Lever 21 is made in a single piece in the shape of a plate and includes a spring 27 in the shape of a stick whose end is wedged between two fixed elements 28, which holds lever 21 elastically in its neutral position shown in FIG. 2, where its tips 22 and 23 do not interfere with star-wheels 11 and 14.

Beaks 22 and 23 are arranged on opposite sides of a first arm 30 of lever 21. On the other side of its pivoting axis 26, lever 21 includes a second wider arm 31, having a relatively large hole 32 whose periphery forms a cam surface 33 having two raised portions 34 and 35 located on two mutually opposite sides of the cam surface. The second arm of lever 21 further includes, on its external periphery, a nose 36 whose function will be described hereinafter.

Drive wheel 20, which is located along one of the faces of drive lever 21, includes two projecting elements which are engaged in the hole 32 of said lever, namely, a drive pin 38 and a cam 39, called the correction cam. Pin 38 is at a distance from the centre of wheel 20 and cooperates with the two raised portions 34 and 35 of cam surface 33, to pivot drive lever 21 once a day in one direction and once in the other direction, so that beaks 22 and 23 move forward the calendar indicators. Outside the two sectors where raised portions 34 and 35 are located, cam surface 33 is quite far away radially from the circular trajectory of pin 38 so that lever 21 can be oscillated without touching said pin. In other words, while pin 38 is not in proximity to one of raised portions 34 and 35, lever 21 can pivot via the effect of correction means that will be described hereinafter.

In FIG. 2, the calendar mechanism is shown in the position that it occupies around 03.30 hours, after pin 38 has passed over raised portion 34 and thus made date star-wheel 11 and hand 4 connected thereto move forward one step.

In order to correct the indications of the date and moon phase indicators which are controlled by drive lever 21, manual correction means 40 are arranged for generating the same pivoting movements of lever 21 as those produced by pin 38 of drive wheel 20. The user actuates correction means 40 from manual control stem 8. These means include a return lever 42 which carries a mobile intermediate wheel 43 arranged to mesh on a fixed intermediate wheel 44 when stem 8 is in a first quelled out position, a position in which a rotation of stem 8 in one direction or the other causes wheel 43 to rotate in the corresponding direction. When stem 8 is pushed into its neutral position, lever 42 pivots such that wheels 43 and 44 are no longer meshing. Such a mechanism is well known and described for example in CH Patent No. 584 926, to which the reader can refer for more detail.

Correction means 40 further include a correction lever device 46 in the form of a bent lever, one end of which is pivotably mounted at 47, whereas the other end is provided with a cam follower formed by a pin 48 which tends to press against cam 39 of drive wheel 20 via the effect of a spring that is not shown. In its median part, correction lever 46 carries a correction wheel 50 capable of meshing with fixed intermediate wheel 44 and provided with one or more projecting elements such as pins 51, for pushing nose 36 of lever 21 in one direction or another as arrows C and D respectively show, and thus pivoting the lever in the desired direction to make beak 22 act on toothing 11*a* or beak 23 on toothing 14*a*, in order to correct the indicator concerned. Lever 21 thus corrects an indicator in the same manner that said indicator is driven daily.

Cam 39 of drive wheel 20 acts on pin 48 of drive lever 46 so as to move said lever between a first position, shown in FIG. 2 and in which correction wheel 50 is meshed with intermediate wheel 44 of the correction gear train, and a second position in which correction wheel 50 is released from intermediate wheel 44. In order to do this, cam 39 has two projecting circular sections 52 and 53, with a large enough radius to push lever 46 back to the aforementioned first position. Between these two sectors, cam 39 has two hollows which enable lever 46 to take its second position, such that correction wheel 50 is released from intermediate wheel 44 and thus cannot be driven by manual control stem 8. Thus a manual correction has to be prevented while drive pin 38 of drive wheel 20 can enter into contact with one of raised portions 34 and 35 of lever 21, which would make the manual correction impossible.

Figure 3:
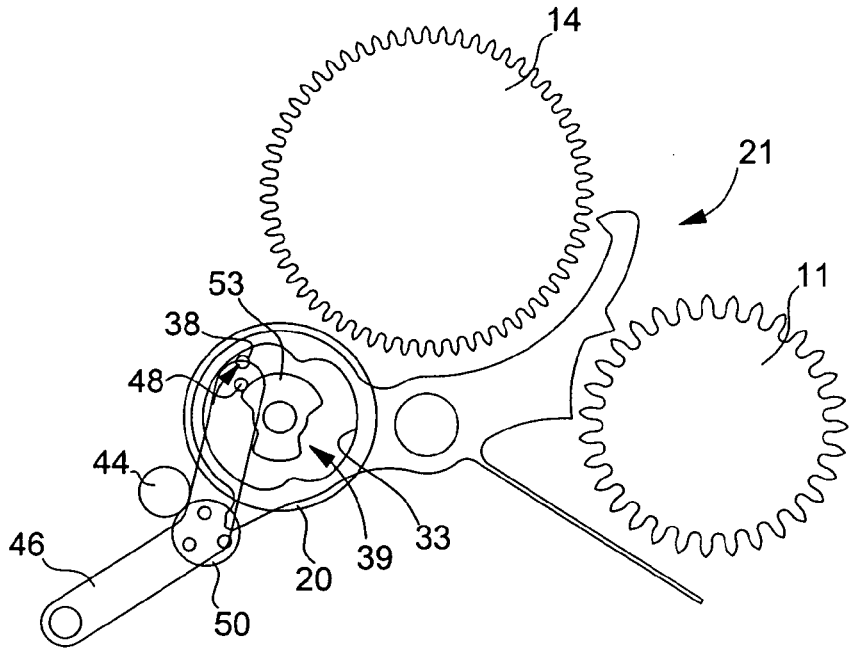
FIGS. 3 to 7 show successive positions of the calendar mechanism for moving the date indicator forward one step.

FIG. 3 shows the state of the calendar mechanism at around 20.30 hours. The projecting sector 53 of cam 39 keeps correction lever 46 in its first position allowing correction, while pin 38 of wheel 20 is far enough away from cam surface 33 of lever 21 to allow the latter to pivot for a correction.

Figure 4:
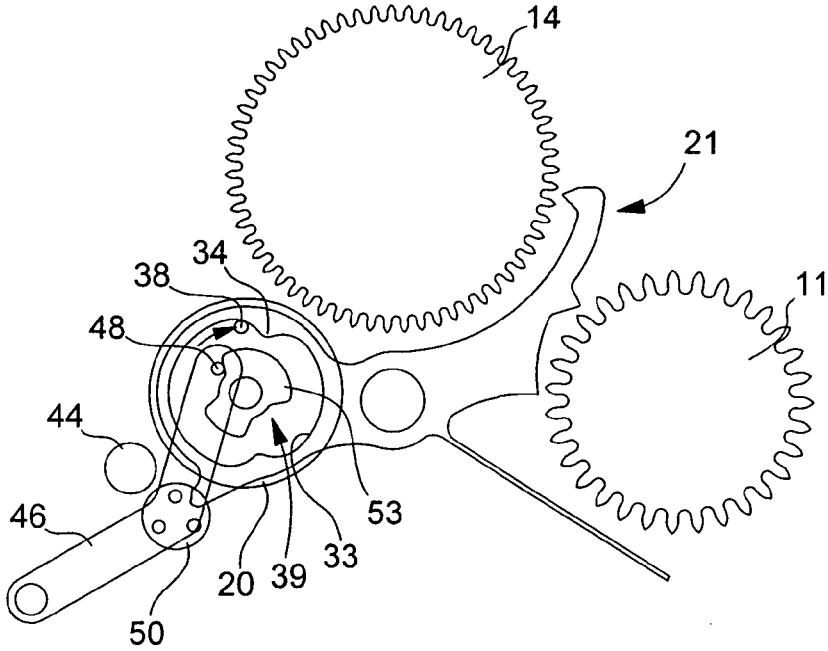

FIG. 4 shows the situation at around 22.30 hours, when pin 38 will enter into contact with cam surface 33 close to raised portion 34. Pin 48 then moves down along a flank of projecting sector 53, correction lever 46 pivots and correction wheel 50 is released from intermediate wheel 44, such that it becomes temporarily impossible to correct the calendar.

Figure 5:
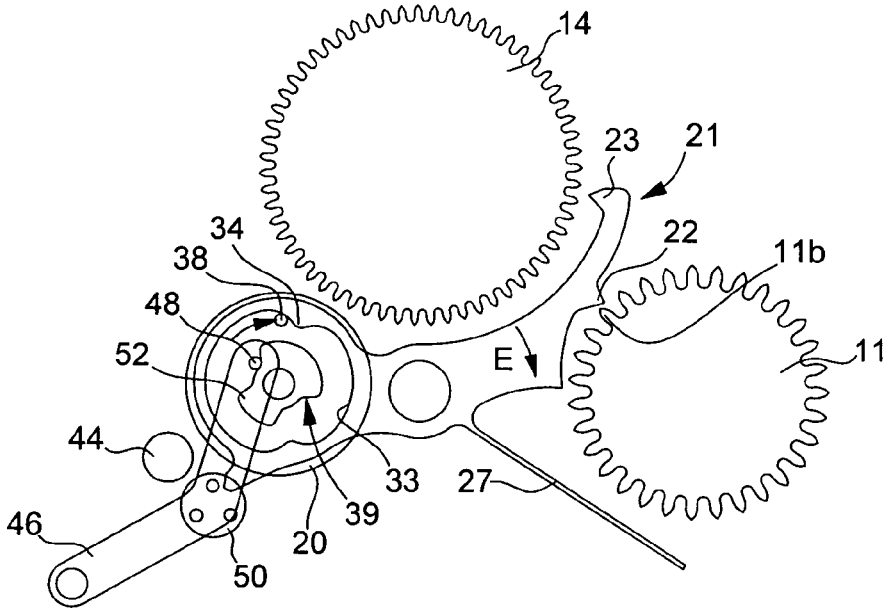
Figure 6:
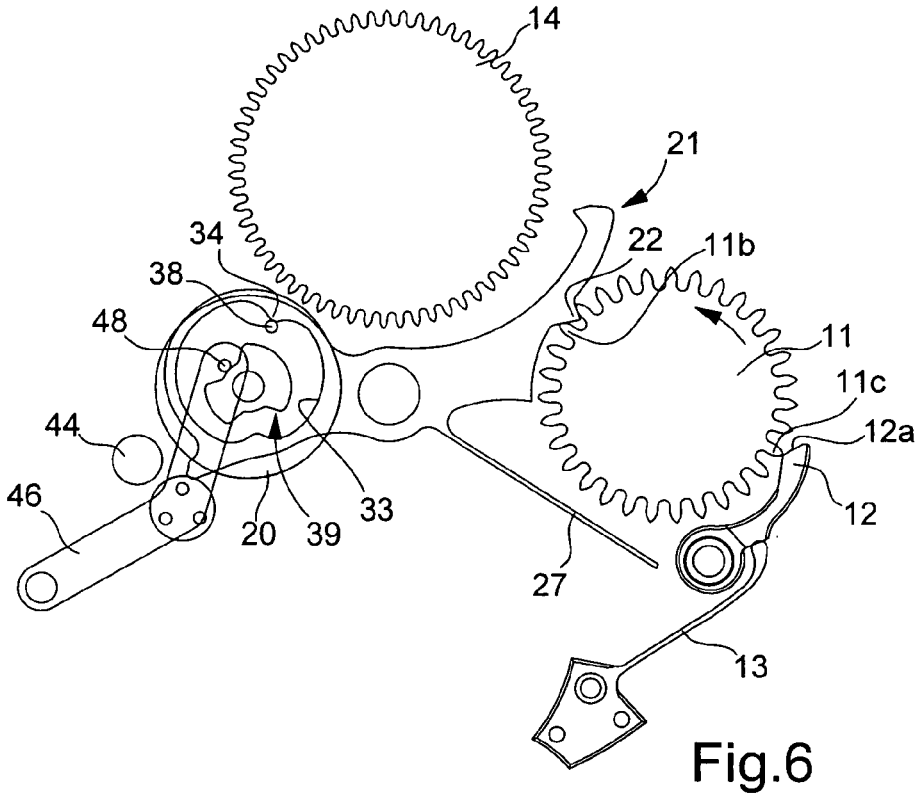
Figure 7:
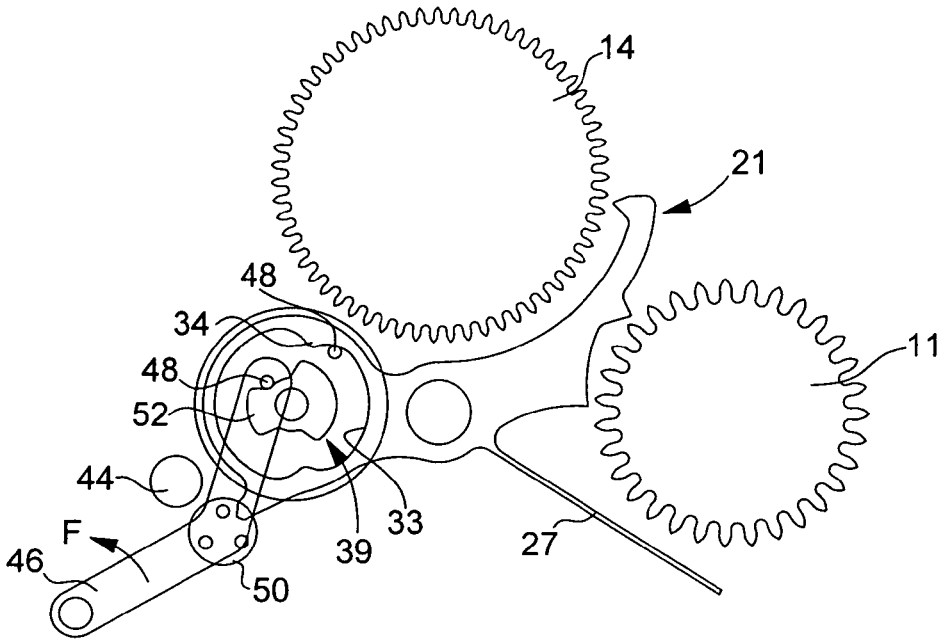

Then, FIGS. 5 to 7 illustrate the movement of the date indicator forward one step at around midnight. At around 23.00 hours, pin 38 starts to push back raised portion 34 and thus to pivot lever 21 around its axis 26 as shown by arrow E. One flank of beak 22 of lever 21 will press against one tooth 11*b* of star-wheel 11 and gradually push this tooth back while making star-wheel 11 rotate in the direction of arrow A to the position shown in FIG. 5, where tooth 11*c* cooperating with jumper-spring 12 passes over the other flank 12*a* of the jumper-spring to be pushed back in the direction of arrow A. Once pin 38 has passed the tip of raised portion 34, lever 21 gradually returns to its neutral position via the effect of spring 27 and is released from the toothing of star-wheel 11, which is then immobilised by jumper-spring 12 in its new position shown in FIG. 7. It is then around 01.30 hours a.m.

Next, pin 38 moves away from cam surface 33, while pin 48 is pushed back by the inclined flank of projecting sector 52 of cam 39, which causes correction lever 46 to pivot as indicated by arrow F, until correction wheel 50 is meshed with intermediate wheel 44. The mechanism thus reaches the position of balance shown in FIG. 2, in which it is again possible to correct the two date indicators.

Figure 8:
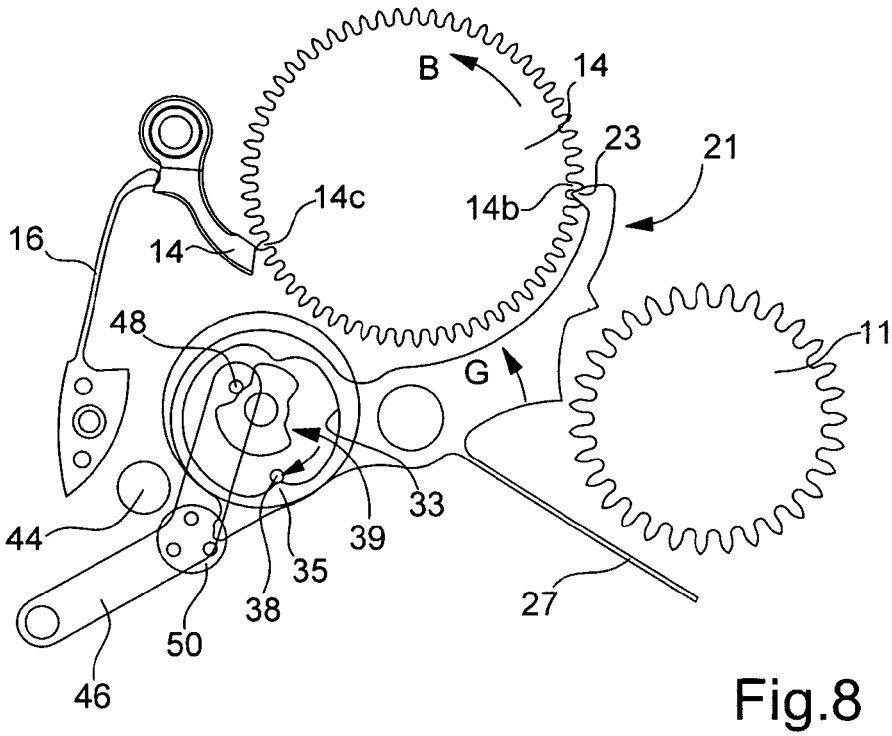
FIG. 8 shows a position of the calendar mechanism at the moment when it moves the moon phase indicator forward one step.

The daily forward movement of the moon indicator is illustrated in FIG. 8 and generates the same movements of correction lever 46 as those that have just been described with reference to FIGS. 2 to 7. However, the action of pin 38 pushing back raised portion 35 of cam surface 33 causes drive lever 21 to pivot in the direction of arrow G, which is opposite to that of arrow E, so that beak 23 of the lever makes moon star-wheel 14 move sufficiently far forward for jumper-spring 15 to pass to the other side of a tooth 14*c* of said star-wheel and finish the rotation of one step once lever 21 returns to its neutral position.

During these operations, pin 48 of correction lever 46 follows a hollow of cam 39, such that correction wheel 50 remains released from pinion 44 and it becomes temporarily impossible to correct the calendar.

Since raised portion 35 of cam surface 33 has to be approximately opposite raised portion 34 to pivot lever 21 in the opposite direction, the daily movement forward of the moon disc is carried out during the course of the day. For example, the position shown in FIG. 8 is reached a little before 10.00 hours.

The preceding description shows that the calendar mechanism according to the invention can be made in a simple and relatively compact form, leaving plenty of free space in the lower region of the dial. Moreover, the correction means from the control stem are particularly simplified with respect to the prior art.

The present invention is not limited to the example described hereinbefore, but extends to any modification or variant obvious to those skilled in the art within the scope of the annexed claims. In particular, one of the indicators can indicate the day of the week, by being associated with a star-wheel whose number of teeth is an integer multiple of seven, or it can indicate another quantity, such as the number of the week, the month or the year. Moreover, the indicator is not necessarily secured to the corresponding star-wheel, but can be associated with the latter by a suitable transmission. For example, instead of hand 4, date star-wheel 11 can drive, by meshing, a date ring whose indications appear in the aperture. One may also envisage drive lever 21 directly driving such a ring.

What is claimed is:

1. A calendar mechanism in a watch, including a first and a second indicator which are each associated with a rotating wheel set provided with a toothing, a drive lever provided with two beaks arranged for acting respectively on the toothing associated with the first or second indicator, depending upon the pivoting direction of the drive lever, to make the corresponding indicator move forward one step, a drive wheel making one revolution per day and provided with a drive element which cooperates with a cam surface of the drive lever to pivot said lever each day in one direction and in an opposite direction from a neutral position and thus make said beaks act on said toothings, and manual correction means for moving the first and second indicators forward step by step independently of each other, wherein the manual correction means act on the drive lever so as to pivot it selectively in one direction or the other to move the corresponding indicator forward one step.

2. The mechanism of claim 1, wherein the manual correction means include a correction wheel driven in rotation selectively in one direction or the other by a manual control stem via a correction gear train, the correction wheel having one or several projecting elements arranged for pressing against a nose of the drive lever so as to pivot the latter in one direction or the opposite direction depending upon the rotational direction of the correction wheel.

3. The mechanism of claim 2, wherein the correction wheel is mounted on a correction lever controlled by the drive wheel, the correction lever being mobile between a first position, in which the correction wheel is meshed with the correction gear train, and a second position in which the correction wheel is released from the correction gear train as long as the drive wheel actuates the drive lever.

4. The mechanism of claim 3, wherein the correction lever includes a cam follower pressing against a cam secured to the drive wheel.

5. The mechanism of claim 1, wherein the neutral position of the drive lever is determined by a spring and wherein said cam surface of said lever is formed by the periphery of a hole, in which said drive element circulates without touching the cam surface except on two raised portions of the latter, such that said lever can pivot via the effect of correction means while the drive element is not located in proximity to one of said raised portions.

6. The mechanism of claim 1, wherein the drive lever pivots about the axis of an hour wheel of the watch, said hour wheel meshing with said drive wheel.

7. The mechanism of claim 1, wherein the first indicator is a date indicator and the second is a moon phase indicator.

8. The mechanism of claim 1, wherein the first indicator is a date indicator and the second is a day indicator.

* * * * *